US006276242B1

(12) United States Patent
Wiggins et al.

(10) Patent No.: US 6,276,242 B1
(45) Date of Patent: Aug. 21, 2001

(54) DRAIN COMPRESSION RING WRENCH

(76) Inventors: Michael S. Wiggins, 1070 Clark Cir., Underwood, IA (US) 51576; Garrett J. Kean, 10002 S. 204th St., Gretna, NE (US) 68028

( * ) Notice: Subject to any disclaimer, the term of this patent is extended or adjusted under 35 U.S.C. 154(b) by 0 days.

(21) Appl. No.: 09/578,979

(22) Filed: May 25, 2000

(51) Int. Cl.[7] ..... B25B 13/56
(52) U.S. Cl. ..... 81/176.15; 81/119
(58) Field of Search ..... 81/176.1, 176.15, 81/176.2, 461, 436, 119

(56) References Cited

U.S. PATENT DOCUMENTS

| | | | | |
|---|---|---|---|---|
| D. 324,630 | | 3/1992 | Moeller . | |
| D. 329,178 | | 9/1992 | Ackerman . | |
| D. 385,166 | | 10/1997 | Mundon . | |
| 1,371,965 | | 3/1921 | York . | |
| 1,653,531 | * | 12/1927 | Affleck et al. | 81/176.15 |
| 2,544,058 | | 3/1951 | Watkins . | |
| 2,770,991 | | 11/1956 | Myers . | |
| 2,909,090 | | 10/1959 | Moore . | |
| 3,657,814 | | 4/1972 | Bohlman . | |
| 3,760,659 | * | 9/1973 | Campbell | 81/176.15 |
| 4,260,026 | | 4/1981 | Deckert . | |
| 4,542,666 | * | 9/1985 | White | 81/176.1 |
| 4,846,025 | | 7/1989 | Keller et al. . | |
| 5,090,276 | | 2/1992 | Groskey . | |
| 5,321,998 | * | 6/1994 | Brown | 81/176.1 |
| 5,575,602 | * | 11/1996 | Savage et al. | 81/176.15 |
| 5,638,590 | | 6/1997 | Silano . | |
| 5,873,290 | | 2/1999 | Chaconas . | |
| 5,957,011 | | 9/1999 | Thompson . | |
| 6,044,732 | * | 4/2000 | Astle | 81/176.15 |

FOREIGN PATENT DOCUMENTS

| | | | | |
|---|---|---|---|---|
| 1176761 | * | 4/1959 | (FR) | 81/176.15 |

* cited by examiner

*Primary Examiner*—Eileen P. Morgan
*Assistant Examiner*—Joni B. Danganan
(74) *Attorney, Agent, or Firm*—Zarley, McKee, Thomte Voorhees & Sease; Dennis L. Thomte

(57) ABSTRACT

Described is a wrench comprising a base plate having a generally circular periphery. A plurality of teeth extend radially from the periphery of the base plate and are adapted to engage the indentations in the top of a compression ring of a base assembly. The base plate has a shaft extending upwardly therefrom. Preferably, the shaft includes a handle portion which an installer may use to apply torque to the tool and, thereby, to the compression ring. The shaft may, however, be adapted for engagement with another tool, such as a pipe wrench or electric drill.

8 Claims, 2 Drawing Sheets

DRAIN COMPRESSION RING WRENCH

BACKGROUND OF THE INVENTION

The present invention relates to a wrench for installing a compression ring in a drain such as those found in bathtub and shower fixtures.

DESCRIPTION OF THE PRIOR ART

Plumbing fixtures, such as bathtubs, showers, and sinks, are commonly provided with a drain hole into which a drain assembly is positioned. The drain assembly is adapted to provide a watertight connection between the plumbing fixture and a waste water pipe. One type of drain assembly commonly utilized in bathtubs and showers is an assembly having three parts: a drain base, a deformable collar, and a compression ring. As can be seen in FIG. 3, the drain base comprises an internally threaded cylindrical member having an outwardly extending upper flange at its upper end and an inwardly extending lower flange at its lower end. The upper flange is adapted to rest on the floor of the bathtub or shower. The deformable collar is positioned within the cylindrical member on the lower flange. The deformable collar is designed to fit around the waste water pipe in a snug, but not watertight, connection. The compression ring is externally threaded and is adapted to be threadably connected to the interior of the cylindrical member. The lower end of the compression ring is adapted to engage the upper end of the deformable collar such that the threadable tightening of the compression ring within the cylindrical member compresses and deforms the collar to produce a watertight seal between the collar and the waste water pipe. Obviously, it is important to provide sufficient rotational torque to the compression ring so that the collar is properly compressed to prevent leakage within the drain assembly.

Such compression rings are commonly tightened by the prior art installation tool shown in FIG. 2. The prior art installation tool is comprised of a thin, elongated metal plate having teeth extending from opposite ends thereof. The plate also commonly has an elongated slot in the center thereof for receiving a screwdriver or the like therein. The prior art installation tool is adapted to have its teeth fit in opposing indentations in the upper end of the compression ring. The installation tool may then be rotated to apply rotational torque to the compression ring with the aid of a screwdriver positioned in the slot of the plate.

The prior art installation tool has many shortcomings. First, the tool is usually made out of comparatively thin metal. Accordingly, the tool will often bend or break before sufficient rotational compression is applied to the deformable collar to create a watertight seal. Second, the tool is sufficiently small such that it will commonly dislocate from the compression ring and fall into the drain.

It is also common for an installer to use a hammer and screwdriver in the manner of a chisel to engage the indentations in the compression ring to rotate and tighten the compression ring thereby. This method of tightening the compression ring is awkward, however, and can result in damage to the compression ring, drain base, or floor of the plumbing fixture.

SUMMARY OF THE INVENTION

A drain compression ring wrench is disclosed for installing a compression ring in a drain wherein the compression ring includes a plurality of indentations or notches formed in the upper end thereof.

The wrench of this invention comprises a base plate having a generally circular periphery. A plurality of spaced-apart teeth extend radially from the periphery of the base plate and are adapted to engage the indentations or notches in the upper end of the compression ring. The base plate has a shaft extending upwardly therefrom with the shaft including a handle portion which an installer may use to apply rotational torque to the tool and, thereby, to the compression ring. The shaft may, however, be adapted for engagement with another tool, such as a pipe wrench or electric drill.

The configuration and dimensions of the wrench are such that the wrench will not fall down the drain. Further, the wrench is adapted to apply torque evenly about the compression ring, minimizing possible damage to the ring.

It is accordingly an object of this invention to provide a wrench for use in installing a compression ring in a drain assembly in an efficient and reliable manner.

It is further an object of this invention to provide a wrench for the use of installing a compression ring that is durable and effective.

It is yet another object of this invention to provide a wrench for use in installing a compression ring in a drain assembly that is not susceptible to falling into the drain.

It is yet another object of this invention to provide a wrench for use in installing a compression ring in a drain assembly that minimizes the risk of damage to the plumbing fixture and the drain assembly.

These and other objects and advantages of the invention will be apparent to one having ordinary skill in the art.

DESCRIPTION OF THE PREFERRED EMBODIMENT

Figure 1:
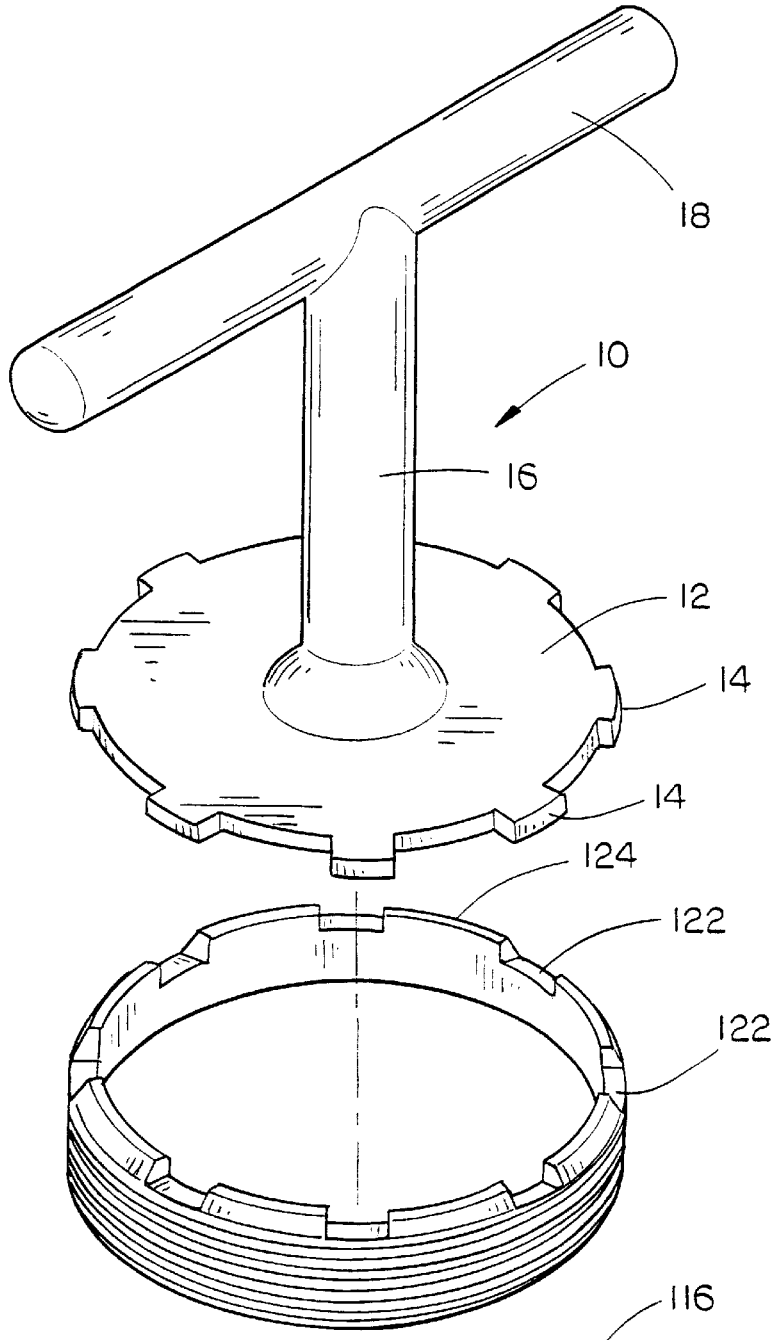
FIG. 1 is an isometric view of a preferred embodiment of a wrench in accordance with this invention, showing its relationship to a compression ring.

The compression ring wrench of this invention is referred to generally by the reference numeral 10 while the reference numeral 100 refers to a conventional drain assembly including a compression ring 102, an annular deformable collar 104, and drain base 106.

Figure 3:
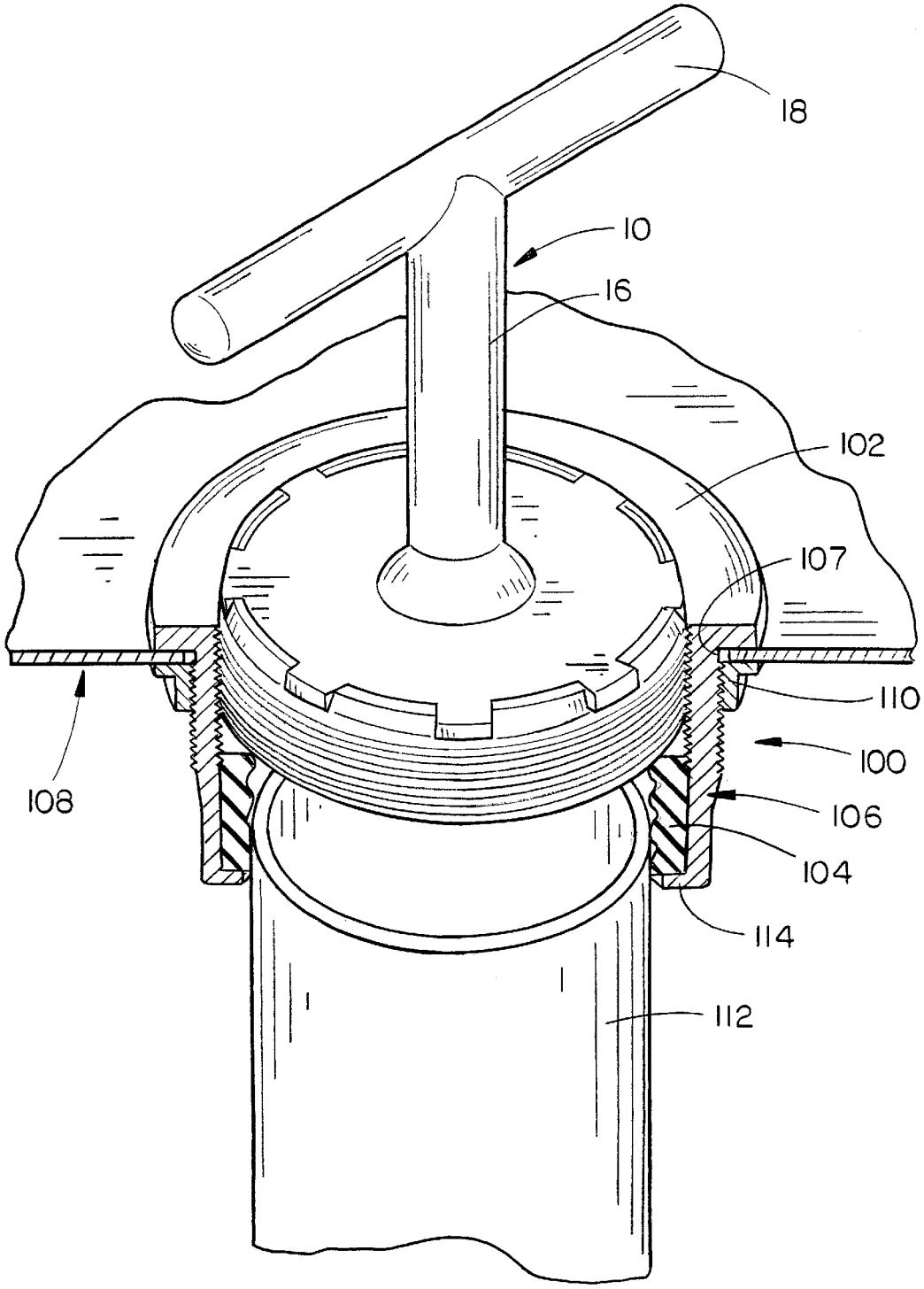
FIG. 3 is an isometric, cutaway view in which the wrench is shown in conjunction with the drain assembly and plumbing fixture.

The drain assembly 100 is commonly installed in the drain hole 107 in the floor of a plumbing fixture 108. The drain assembly 100 is commonly installed in the following manner. The drain base 106 is placed in the drain hole 107 of the plumbing fixture 108 and secured therein. In FIG. 3, the drain base 106 is secured by an internally threaded collar 110, but other means, such as snap rings and bolts, may be employed for this purpose. The annular deformable collar 104 is placed in the drain base 106 and around the drain pipe 112 so as to rest upon the lower flange 114 of drain base 106. The compression ring 102 is threadably inserted into the drain base 106 above the annular deformable collar 104. The compression ring 102 is threadably tightened against the annular deformable collar 104 to urge it into place against the lower flange 114 of the drain base 106. The compression ring 102 is tightened further against the annular deformable collar 104 causing the annular deformable collar 104 to deform inwardly against the drain pipe 112 and form a watertight seal therebetween.

Figure 2:
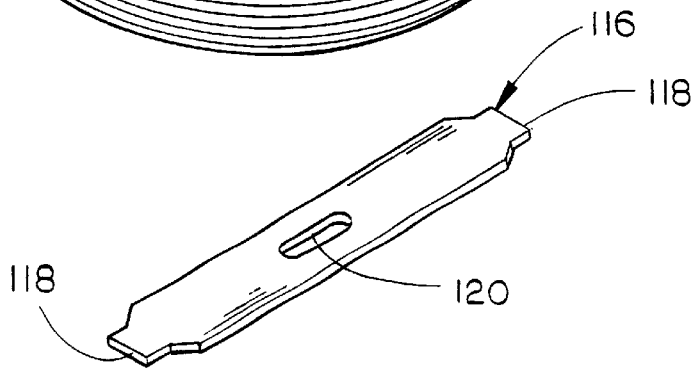
FIG. 2 (PRIOR ART)
FIG. 2 is an isometric view of a prior art installation tool.

The tool that has previously been used for the purpose of tightening the compression ring 102 is designated by the numeral 116 and is shown in FIG. 2. The prior art installation tool 116 generally comprises a thin elongated metal member having teeth 118 on opposite ends thereof and a slot 120 in its center. The teeth 118 are adapted to fit into opposing indentations or notches 122 in the upper end of the compression ring 102, described more fully herein below. A screwdriver or similar tool was then placed in the slot 120 and rotated to apply torque to the compression ring 102.

As stated, the compression ring 102 is supplied with a plurality of indentations or notches 122 on its upper end 124. The indentations 122 are provided to allow a tool to obtain purchase on the compression ring 102 for the application of torque, as previously described.

The wrench 10 in accordance with this invention is shown in FIG. 1. The wrench 10 includes a base plate 12 having a plurality of teeth 14 positioned on the periphery thereof. Preferably, the wrench 10 has the same number of teeth 14 as the compression ring 102 has indentations 122 so that the wrench 10 and the compression ring 102 may be arranged in a mating configuration.

The wrench 10 further includes a shaft 16 extending upwardly from the base plate 12. Preferably, the shaft 16 has a handle 18 positioned at the upper end thereof. Although the handle 18 shown in FIGS. 1 and 3 is affixed to the top of the shaft 16 to define a T-shape, numerous other configurations for the handle 18 are contemplated. Among the other configurations contemplated for the handle 18 are a removable handle, a handle in sliding engagement with the shaft 16, an ergonomic handle, and other configurations well known to those having ordinary skill in the art. It is also contemplated that the wrench 10 have no handle 18, but rather be adapted to be held by another tool such as a pipe wrench, drill, or the like for the application of torque thereto.

In use, the wrench 10 is positioned so that the teeth 14 are received by the indentations or notches 122 of the compression ring 102 after the compression ring 102 has been initially threaded into drain base 106 above collar 104. Rotational torque is applied to the handle 18 and is translated to the compression ring 102. Because the torque is applied to the compression ring 102 at a plurality of indentations 122, rather than simply at opposing indentations 122, the pressure applied to each of the indentations 122 is lessened, reducing the incidence of damage to the compression ring 102 during installation.

Although not shown, the base plate 12 may be of conical configuration. Such a configuration may be of assistance in seating the wrench 10 in the compression ring 102 for installation. Whether of circular or conical configuration, the base plate 12 must be of a size that will prevent the wrench 10 from falling into the drain.

Thus it can be seen that the novel wrench 10 has been provided for the installation of a compression ring 102 within a drain assembly 100. Further, it can be seen that the invention accomplishes at least all of its stated objectives.

We claim:

1. In combination:

a drain compression ring for use with a drain assembly that includes an internally threaded drain base and a deformable collar, said drain compression ring comprising an externally threaded ring having a lower end, and an upper end having a plurality of indentations formed therein;

said lower end of said ring being adapted to contact and compress the deformable collar;

and a compression ring wrench for use with said drain compression ring;

said compression ring wrench comprising a base plate having a periphery and a plurality of spaced-apart teeth provided on said periphery, said plurality of spaced-apart teeth adapted to engage the indentations of the drain compression ring; and a shaft mounted on said base plate and extending upwardly therefrom;

whereby said compression ring wrench may be engaged with said compression ring and rotated to install said compression ring within the internally threaded drain base and to compress the deformable collar.

2. The combination of claim 1 wherein said compression ring wrench further comprises a handle on said shaft.

3. The combination of claim 2 wherein said handle extends transversely from said shaft.

4. The combination of claim 1 wherein said base plate is substantially circular.

5. The combination of claim 4 wherein-said plurality of teeth extend radially from said periphery of said base plate.

6. The combination of claim 4 wherein said base plate has a center and said shaft extends upwardly therefrom.

7. The combination of claim 1 wherein said base plate is substantially conical.

8. A method of installing a deformable collar and a drain compression ring, having an upper edge with a plurality of indentations therein, in a drain assembly, comprising the steps of:

providing a drain compression ring wrench comprising a base plate having a periphery with a plurality of spaced-apart teeth provided on said periphery, said plurality of spaced-apart teeth adapted to engage the indentations of the drain compression ring; said drain compression ring wrench further comprising a shaft mounted on said base plate and extending upwardly therefrom;

positioning the deformable collar in the drain assembly;

threading the compression drain ring into said drain assembly;

positioning said drain compression ring wrench so that said teeth are received by said indentations in the drain compression ring; and rotating said drain compression ring wrench to deform the deformable collar in the drain assembly.

* * * * *